US009701433B2

(12) United States Patent
Boukobza et al.

(10) Patent No.: US 9,701,433 B2
(45) Date of Patent: Jul. 11, 2017

(54) CONTAINER COMPRISING A BOTTOM PROVIDED WITH A VARYING ARCH

(71) Applicant: SIDEL PARTICIPATIONS, Octeville-sur-Mer (FR)

(72) Inventors: Michel Boukobza, Octeville-sur-Mer (FR); Pierrick Protais, Octeville-sur-Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 0 days.

(21) Appl. No.: 15/029,795

(22) PCT Filed: Oct. 27, 2014

(86) PCT No.: PCT/FR2014/052731
§ 371 (c)(1),
(2) Date: Apr. 15, 2016

(87) PCT Pub. No.: WO2015/092172
PCT Pub. Date: Jun. 25, 2015

(65) Prior Publication Data

US 2016/0236807 A1 Aug. 18, 2016

(30) Foreign Application Priority Data

Dec. 17, 2013 (FR) ..... 13 62745

(51) Int. Cl.
*B65D 1/02* (2006.01)
*B65D 21/02* (2006.01)

(52) U.S. Cl.
CPC ..... *B65D 1/0276* (2013.01); *B65D 21/0231* (2013.01); *B65D 2501/0036* (2013.01); *B65D 2501/0081* (2013.01)

(58) Field of Classification Search
CPC .. B65D 1/0276; B65D 1/0261; B65D 1/0223; B65D 11/20; B65D 15/24;
(Continued)

(56) References Cited

U.S. PATENT DOCUMENTS

2014/0319010 A1 10/2014 Derrien et al.

FOREIGN PATENT DOCUMENTS

FR 2 983 940 A1 6/2013
WO 2013/088006 A1 6/2013

OTHER PUBLICATIONS

International Search Report, dated Feb. 19, 2015, from corresponding PCT Application.

*Primary Examiner* — Robert J Hicks
(74) *Attorney, Agent, or Firm* — Young & Thompson

(57) ABSTRACT

A plastics container (1) includes a body (2) with a polygonal section which extends along a main axis (X), a shoulder (4) which extends in continuation of the body (2) on an upper side, a neck (5) which extends in continuation of the shoulder (4), and a bottom (3) which extends in continuation of the body (2) on a lower side, the bottom (3) including: an annular seat (9) defining a standing perimeter (10), having a polygonal contour formed from a plurality of sides and vertices, and approximately perpendicular to the main axis (X); a central peg (16) having a side wall (17) that has a generally axisymmetric frustoconical shape about the main axis (X) and which is connected to the rest of the bottom (3) by a connecting fillet (19) which has a radius that is variable in revolution about the main axis (X) of the container.

17 Claims, 3 Drawing Sheets

(58) Field of Classification Search
CPC ..... B65D 21/0231; B65D 21/023; B65D 21/0209; B65D 21/0233
USPC ..... 215/371, 370; 220/608, 604, 623, 610, 220/DIG. 13, DIG. 14; 206/507, 505, 206/504, 503; D9/561, 560, 559, 571, D9/566, 520, 516
See application file for complete search history.

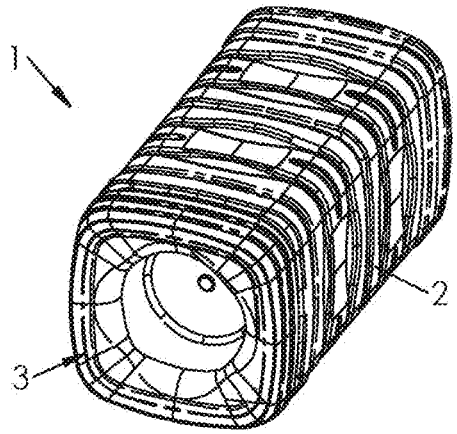
FIG.1
FIG.2
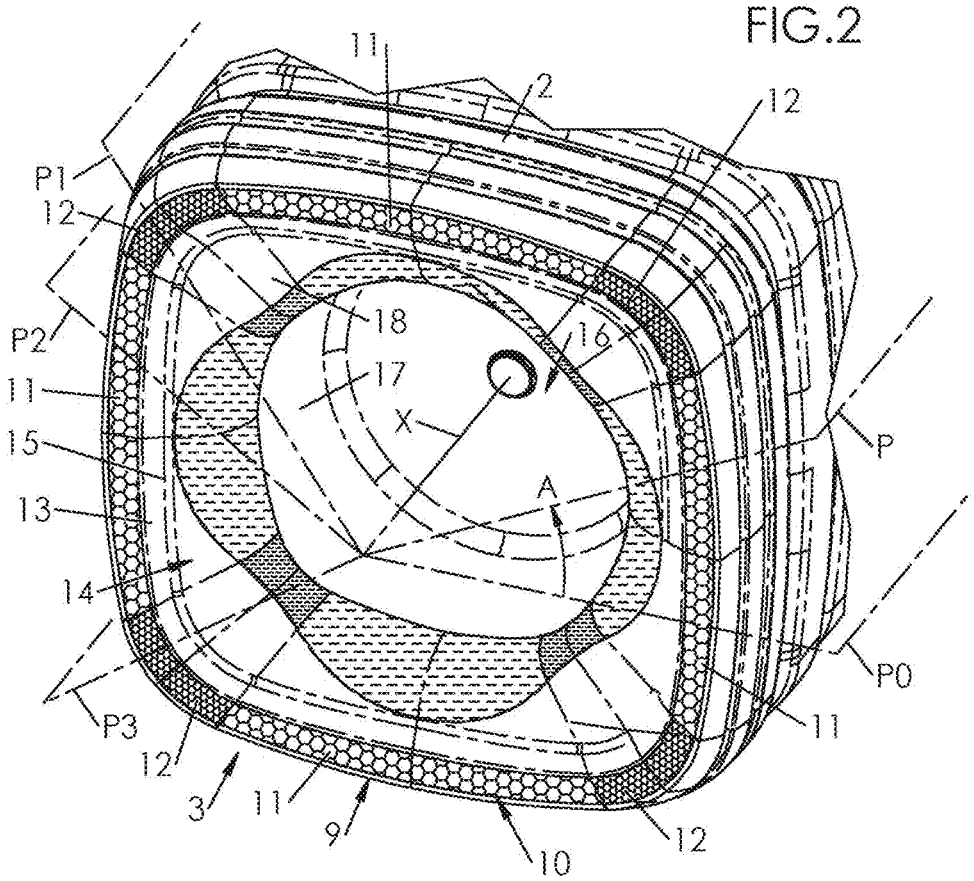

CONTAINER COMPRISING A BOTTOM PROVIDED WITH A VARYING ARCH

The invention relates to containers whose bottoms comprise an annular seat defining a placement perimeter with a polygonal contour formed by multiple sides and vertices and a central peg having a side wall that is tapered overall in revolution around the main axis and that is connected to the rest of the bottom by a connecting fillet.

Containers that have such a structure are produced to meet technical or aesthetic requirements. Among the containers of this type, meeting technical requirements, there are stackable containers, with the latter being shaped to be able to be stacked on one another and provided for this purpose with a bottom and a neck that are essentially complementary in such a way that the neck of an underlying container can be inserted into a recess made in the bottom of an identical upper container, with the bottom of the latter resting on a shoulder of the underlying container.

To make such a stacking possible, the bottom of each container is provided with an annular seat defining a placement plane that is complementary to a peripheral support face that is defined on the shoulder of an underlying container and a central peg that is designed to accommodate the neck of the underlying container.

The stacking of the containers subjects the latter to significant axial compression forces that can induce deformations by buckling, able to bring about a collapse of the stack. Experience shows that the containers with polygonal cross-sections (typically square or rectangular) offer a better resistance to buckling than the containers with a circular (or oval) cross-section. There is therefore a tendency to favor the polygonal cross-section for the manufacture of the stackable containers. Within this context, the terms "polygon" and "polygonal" reflect not only a perfect geometry (purely mathematical and theoretical) in which the sides of the polygon are straight segments and its vertices are points, but also cover approximate geometries in which the vertices of the polygon are rounded, and in which the sides can be curves (typically in the shape of arcs). In practice, it goes without saying that only the approximate geometries are applicable, taking into account problems that would arise in correctly forming a container with perfect polygonal geometry.

It is possible to find an illustration of a stackable container with a square cross-section (according to the terminology defined above) in the application FR 2 983 840 or its international equivalent WO 2013/088006.

This container is satisfactory overall but can be improved upon: defects in surface evenness have in fact been noted repeatedly in the placement plane. These defects in surface evenness, which can damage the stability of the container, seem to result from difficulties for the material to correctly take the impression of the mold in certain zones of the bottom. Imperfect imprint-taking has been noted primarily in low-capacity (typically 0.51) containers with polygonal cross-sections essentially on the cross-sections of the placement plane extending over the sides of the polygon. The cause of this phenomenon undoubtedly lies in the asymmetry of revolution of the container, since the symmetrical containers do not in general have the defect of surface unevenness of the placement plane.

One solution for attempting to improve the imprint-taking of the bottoms of containers with polygonal cross-sections consists in using blow-molding molds whose mold bottom or a portion of the latter is displaced in the direction of the neck of the container (its part opposite to the bottom) during the forming stages so as to promote the imprint-taking of the container's bottom. The displacement stage, which makes it possible to accompany the material of the container's bottom during the displacement of the mold bottom, is called "boxing," and the containers thus obtained are called "box-bottom" containers. It was noted, however, that although the boxing provides a certain improvement, the fact remains that in some cases, the surface evenness of the placement plane is not perfect.

A solution for solving this problem would consist in modifying the shape of the container to make it symmetrical in revolution. However, as we saw, this solution would not meet the requirements specific to stacking, which give preference to a polygonal cross-section (typically square or rectangular). In addition, even though for certain types of containers (including for certain stackable containers), a cross-section that is symmetrical in revolution is acceptable, the fact of being able to obtain containers with polygonal cross-sections with good imprint-taking undeniably opens up perspectives in terms of creativity.

One objective is consequently to propose a container with a polygonal cross-section, whose bottom ensures ease of shaping (also called blow-moldability) so as to obtain a suitable placement plane and that furthermore offers good mechanical resistance to the forces arising from vertical compression, in particular in the case of superpositioning or stacking.

For this purpose, there is proposed a container made of plastic material, comprising a body with a polygonal cross-section that extends along a main axis, a shoulder that forms an extension of the body of an upper side, a neck that forms an extension of the shoulder, and a bottom that forms an extension of the body of a lower side, with said bottom comprising:

- An annular seat that defines a placement perimeter, with a polygonal contour formed by a number of sides and vertices, essentially perpendicular to the main axis;
- A central peg that has a side wall that is tapered overall in revolution around the main axis and that is connected to the rest of the bottom by a connecting fillet that has a variable radius in revolution around the main axis of the container, with this radius having a minimum value in any sector delimited by a vertex of the placement perimeter, and a maximum value in any sector delimited by a side of the placement perimeter.

This container ensures both good blow-moldability and good mechanical resistance to the compression forces generated by a superpositioning or a stacking. In particular, it was noted that the placement plane does not undergo measurable surface evenness defects, in particular for the low-capacity (in particular 0.5 l) containers.

Various additional characteristics can be provided, by themselves or combined:

- The radius of the connecting fillet has its maximum value in any bisecting plane with a side of the placement perimeter;
- The radius of the connecting fillet has its minimum value in any bisecting plane with a vertex of the placement perimeter;
- The radius of the connecting fillet is continuously variable between its minimum value and its maximum value;
- The maximum value and the minimum value of the radius of the connecting fillet are in a ratio of between 2 and 3;
- The maximum value and the minimum value of the radius of the connecting fillet are in a ratio of approximately 2.5;

The placement perimeter has a square contour that comprises four sides and four vertices;

The radius of the connecting fillet has four maximum values facing the sides and four minimum values facing the vertices;

The radius of the connecting fillet has sinusoidal variations in revolution around the main axis;

Under the neck, the shoulder comprises a tapered area and, at its junction with the body, a peripheral support face, with a polygonal contour, complementary to the placement perimeter defined by the annular seat, essentially perpendicular to the main axis.

Other objects and advantages will be brought out in the description of embodiments, provided below with reference to the accompanying drawings, in which:

FIG. 1 is a perspective bottom view, showing, in a realistic manner, a container with a polygonal cross-section;

FIG. 2 is a realistic detail view showing, on an enlarged scale, the bottom of the container of FIG. 1; for better understanding of the shapes of the bottom, certain lines marking the curvature of the surfaces of the latter were plotted; in addition, for creating the placement perimeter, the latter was filled with a honeycomb pattern, and for creating the connecting fillet of the central peg, the latter was filled with a dot pattern;

Figure 3:
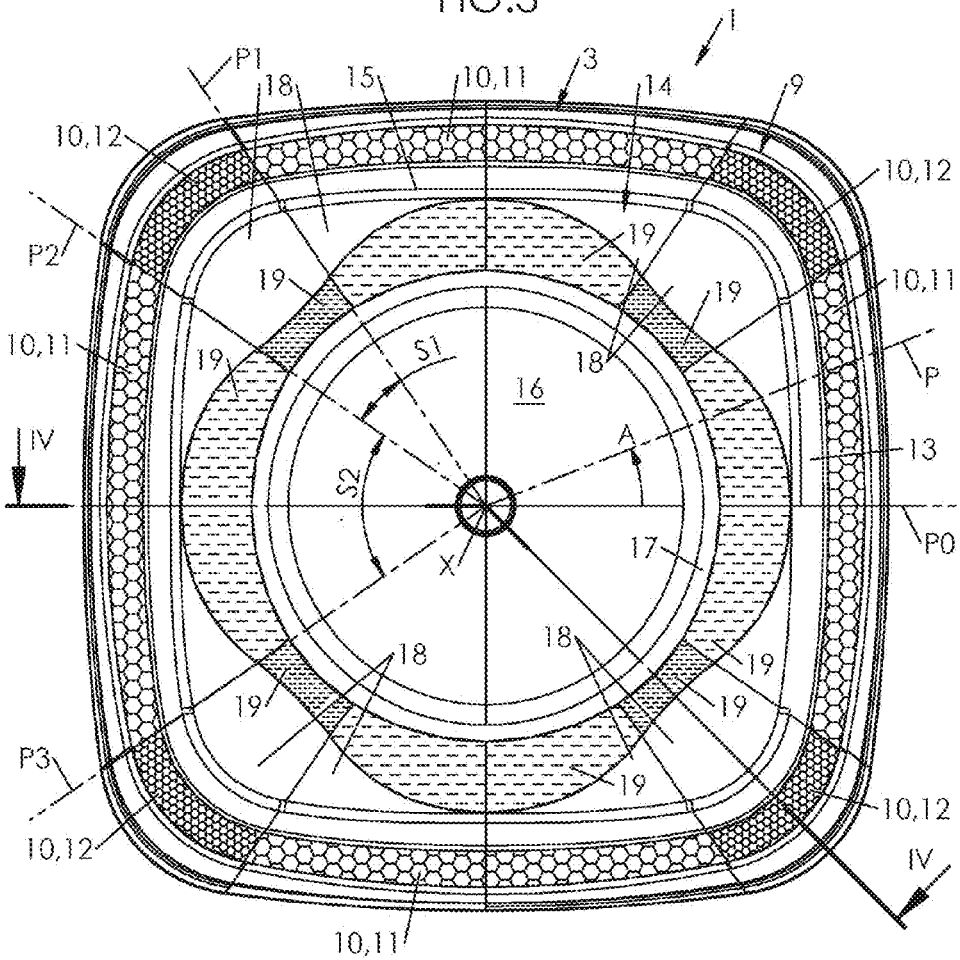
FIG. 3 is a realistic bottom plan view of the bottom of FIG. 2, on which the placement perimeter and the connecting fillet of the central peg are also filled, respectively with a honeycomb pattern or with a dot pattern.

FIG. 1 shows a container 1 formed by blow molding or stretch blow molding starting from a preform made of thermoplastic material such as PET (polyethylene terephthalate). This container 1, in this case a bottle, typically has a 0.5 l capacity, but this capacity is not limiting and could be greater, for example 1.5 l.

The container 1 comprises a body 2 that extends along a main axis X. The body 2 has a polygonal cross-section (i.e., perpendicularly to the main axis X). In this application, the terms "polygon" and "polygonal" have a wide acceptance and are not limited to the strict mathematical definition of a closed geometry that consists of straight segments (forming the sides of the polygon), contiguous by their ends (forming the specific vertices of the polygon), but rather cover close geometries in which the sides can be curves (for example, in the shape of arcs) and rounded vertices. According to this definition of the polygon, the cross-section of the container that is illustrated in the figures (cf. in particular FIG. 3) can be described as square.

The sides of the polygon formed by the cross-section of the body 2 do not necessarily have the same arc length, and the angles with the vertices are not necessarily constant. In other words, the polygon is not necessarily regular. Likewise, the number of sides (equal to the number of vertices) can be either even or odd. In this case, in the square embodiment that is illustrated, this number is even, equal to 4.

The body 2 is extended, from a lower side, by a bottom 3, and, from an upper side opposite to the bottom 3, by a shoulder 4 that is itself extended by a neck 5 that defines a lip. The neck 5 is arranged (for example threaded) to make possible the removable attachment of a stopper 6.

Figure 4:
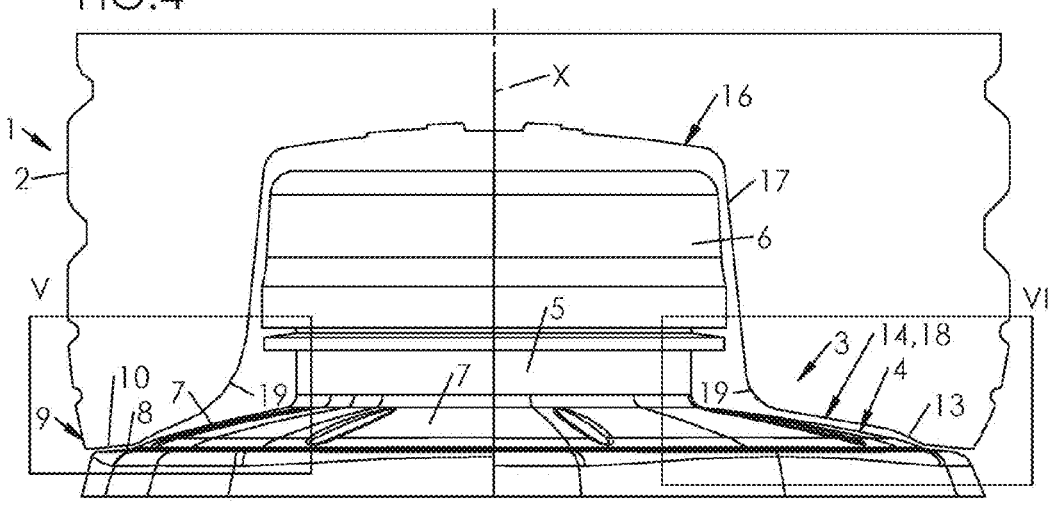
FIG. 4 is a flattened cutaway view of the bottom of FIG. 3, along the broken cutting line IV-IV, which furthermore shows the shoulder of a container on which the bottom of FIG. 3 would be stacked.

The shoulder 4 forms a transition between the neck 5 and the body 2. Under the neck 5, the shoulder 4 comprises a tapered area 7. As illustrated in FIG. 4, the tapered area 7 is not directly contiguous with the body 2, with the shoulder 4 comprising a peripheral face 8 that, in the case of a stackable container, is a support face with a polygonal contour (in the general meaning indicated above) that is similar to that of the cross-section of the body 2. In this case, this contour is therefore square.

This peripheral support face 8 extends essentially in a transverse plane from an upper end of the body 2 to an inside edge that forms a junction with the tapered area 7. According to a preferred embodiment, illustrated in FIG. 4, the peripheral support face 8 is not completely flat but rather forms a slight taper (by an angle of several degrees).

As can be seen in FIG. 4, the bottom 3 can be shaped to accommodate the upper portion (shoulder 4 and neck 5) of an identical underlying container 1in such a way as to make possible the stacking of the containers 1. More specifically, the bottom 3 is partially shaped in a manner complementary to the shoulder 4, in such a way as to make possible the stacking by simple insertion of the shoulder 4 of the underlying container 1 into the bottom 3 of the upper container 1.

Thus, in such a case of a stackable container, the bottom 3 comprises, in the first place, an annular seat 9 that forms an extension of the body 2 and defines a placement perimeter 10 that is complementary to the peripheral support face 8 of the shoulder 4.

The placement perimeter 10 is a strip of material of small width in relation to the overall transverse extension of the bottom 3. To facilitate engagement on the peripheral support face 8 of the underlying container 1, the placement perimeter 10 is not completely flat but rather has, in relation to a transverse plane, a slight reverse taper, as illustrated in FIG. 4.

As illustrated in FIGS. 2 and 3, applicable to containers that may or may not be stackable, the placement perimeter 10 has a polygonal contour that is similar to that of the container 1. In this case, this contour is square (in the meaning indicated above). The placement perimeter 10 comprises a number of sides 11, straight or curved (as in the illustrated example), as well as top zones (more simply called vertices below) 12 where the sides join. As FIGS. 2 and 3 clearly show, where the placement perimeter 10 is created with a honeycomb pattern, the vertices 12 are rounded (it is therefore understood that they are not points but rather have a certain arc length).

More specifically, the sides 11 of the placement perimeter 10 are created with a relatively loose honeycomb pattern, and the vertices 12 are created with a denser honeycomb pattern. The junction lines between the sides 11 and the vertices 12 are provided by way of indication and are not visible on the physical container.

In the illustrated example, where the placement perimeter 10 is regular (in this case, a square), this perimeter 10 is invariant by rotation around the main axis X by an angle of $$\frac{2\pi}{N},$$

where N is the number of sides (or vertices) of the polygon. Consequently, the geometric properties of each side 11 can be transposed to the other sides 11, just as the geometric properties of each vertex 12 can be transposed to the other vertices 12.

The focus is consequently on a single side 11-vertex 12 pair, and the two half-planes that are secant to the main axis X and that frame the vertex 12 are denoted P1 and P2, and the half-plane that extends from the main axis X and that frames, with the plane P2, the side 11 is denoted P3. The planes P1 and P2 thus define together a first sector S1 of the space delimited by vertex 12 (in other words, resting on the ends of the vertex 12 at the junctions with the adjacent sides 11), and the planes P2 and P1 define together a second sector S2 of the space, adjacent to the first sector S1, and delimited by the side 11 (in other words, resting on the ends of the side 11 at the junctions with the adjacent vertices 12).

The annular seat 9 furthermore defines an annular rim 13 that extends in a reverse taper from an inside edge of the placement perimeter 10 and is essentially complementary to the tapered area 7 of the underlying container 1, in the vicinity of the junction of the tapered area 7 and the peripheral support face 8.

In the second place, the bottom 3 comprises a central part 14 that extends from the seat 9—and more specifically from an inside edge 15 of the rim 13—in the direction of the main axis X.

As FIGS. 2 and 3 show, the central part 14 is in two parts and comprises:

- A central peg 16 that has a side wall 17 that is tapered overall in revolution around the main axis X (with an angle of conicity of between 10° and 20° and preferably of approximately) 12°, with this peg 16 being shaped and sized so as to completely encompass the stoppered neck 5 of the underlying container 1.
- An at least partially complementary arch 18 of the tapered area 7 of the shoulder 4 of the underlying container 1, with this arch 18 extending from the rim 13 in the direction of the main axis X.

The side wall 17 of the peg 16 is described as tapered "overall" to the extent that the wall 17 could be ribbed while having, at its vertex, a more narrow width than at its base.

The peg 16 is connected to the rest of the bottom 3 by a connecting fillet 19 whose radius is denoted R, measured in any plane as axial half-plane P (i.e., any half-plane that extends from the main axis X). P0 refers to a reference axial half-plane that extends from the main axis X and that passes through the center of one of the sides 11 (located on the right in FIGS. 2 and 3). Furthermore, the angle between any plane P and the plane P0, measured in the trigonometric (or counterclockwise) direction around the main axis X, is denoted A.

Figure 5:
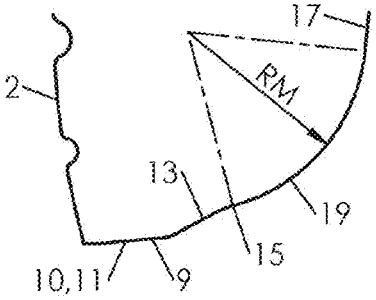
FIGS. 5 and 6 are detail views of the bottom, on an enlarged scale, along the rectangular inserts V and VI plotted in FIG. 4.
Figure 6:
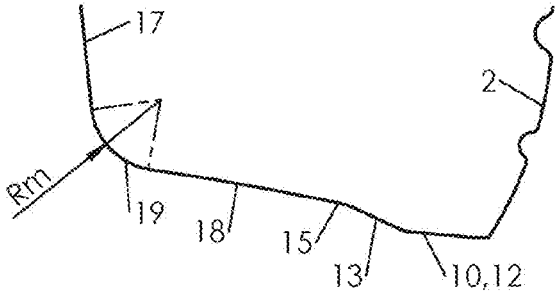

As FIGS. 2 and 3, as well as FIGS. 5 and 6, show, the radius R of the fillet 19 is variable in revolution around the main axis X, i.e., the radius R is a variable function of A.

In particular, the radius R has:

- A minimum value Rm in the first sector S1 delimited by the vertex 12 (or in any equivalent sector delimited by any vertex 12 of the placement perimeter 10),
- A maximum value RM in the second sector S2 delimited by the side 11 (or in any equivalent sector delimited by any side 11 of the placement perimeter 10).

By definition, the maximum value RM of the radius R is strictly greater than its minimum value Rm:

$$RM > Rm$$

According to a particular embodiment illustrated in the figures, where the container 1 has plane symmetries (in relation to axial planes passing through the centers of the sides 11 or through the centers of the vertices 12), i.e., the polygon formed by the cross-section of the container (or by the placement perimeter) is regular, the minimum value Rm is measured in the bisecting plane of any sector S1 delimited by a vertex 12, and the maximum value RM is measured in the bisecting plane of any sector S2 delimited by a side 11.

Thus, in the example illustrated in the figures, where the placement perimeter 10 (like the cross-section of the body 2) has a square shape, the radius R of the fillet 19 passes through four minimum values Rm (facing the vertices 12, i.e., in the bisecting planes of the vertices 12), and four maximum values RM (facing the sides 11, i.e., in the bisecting planes of any side 11).

A better blow-moldabilty of the bottom 3, i.e., a greater ease—and a better quality—of the shaping of the bottom 3, arises from this variability of the radius R. Actually, the relatively large value of the radius RM facing the sides 11 makes it possible, in any sector S2, to minimize the quantity of material necessary to the shaping. Taking into account the relative narrowness of the volume defined between the peg 16 and the body 2 in the container 1 (primarily when the latter is of low capacity—typically 0.5 l), a better creep of the material toward the seat 9 results because of the larger quantity of material set aside for the formation of the fillet 19 and ultimately a better surface evenness of the placement perimeter 10.

Figure 7:
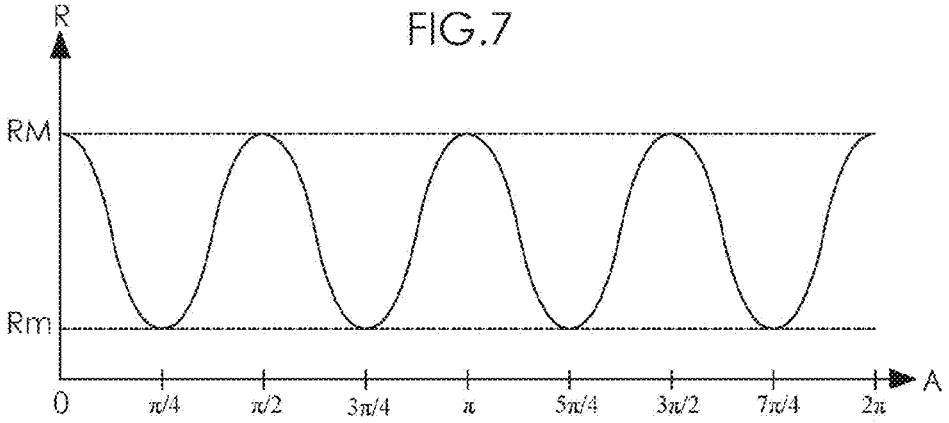
FIG. 7 is a diagram that illustrates the variations of the radius of the connecting fillet of the peg with the rest of the bottom, based on the angle between the measuring half-plane and a reference half-plane centered on a side of the placement perimeter, in a complete revolution around the axis of the container.

According to a preferred embodiment, the radius R is continuously variable between its minimum value Rm and its maximum value RM. A curve that illustrates the variations of the radius R over a complete revolution around the main axis X was plotted on the diagram of FIG. 7, with the angle A (measured in radians) thus varying between the value zero and 2π. It is seen that, taking into account the arbitrary definition of the angle zero (in the plane bisecting a side 11), the radius R has its minimum value Rm at $$A = \frac{\pi}{4},\ A = \frac{3\pi}{4},\ A = \frac{5\pi}{4},\ A = \frac{7\pi}{4},$$

angles and its maximum value RM at angles $$A = 0,\ A = \frac{\pi}{2},\ A = \pi \text{ et } A = \frac{2\pi}{3}.$$

It will be noted that, in the illustrated example, the radius R has sinusoidal (at least by approximation) variations in revolution around the main axis X (i.e., based on the angle A).

Furthermore, the maximum value RM and the minimum value Rm of the radius R are preferably in a ratio of between 2 and 3:

$$2 \leq \frac{RM}{Rm} \leq 3$$

In the illustrated embodiment, this ratio is approximately 2.5:

$$\frac{RM}{Rm} \cong 2.5$$

As the figures, and in particular FIGS. 2 and 3, show, the radial extension of the arch 18, measured in a transverse plane (perpendicular to the main axis X), varies in a manner opposite to the radius R of the fillet 19. Thus, the radial extension of the arch 18 is maximum in the bisecting plane at any vertex 12 and minimum in the bisecting plane at any side 11. In some cases (as in the illustrated example), it may be that the radial extension of the arch 18 is zero, or close to the value zero, in the bisecting plane at any side 11. In other words, in this embodiment, the side wall 17 of the peg 16 is connected directly, via the fillet 19, to the seat 9, and more specifically to the rim 13. In this case, the arch 18 is not, strictly speaking, individual but rather is formed by a set of portions distributed angularly around the main axis X and centered on the bisecting planes of the vertices 12. This design does not impair the stability of the container. In particular, in the square embodiment illustrated, the arch 18 located in the area of the vertices 12 makes it possible to ensure sufficient support in the tapered area 7 of the underlying container 1.

When, as is shown in FIG. 4, the container 1 is stacked on an underlying container 1, with the shoulder 4 of the underlying container 1 being inserted into the bottom 3 of the upper container 1:

The neck 5 of the underlying container (stopper 6 included) is housed in the peg 16 of the upper container 1;

The placement perimeter 10 of the upper container 1 is applied against the peripheral annular support face 8 of the underlying container 1;

The outside edge of the tapered area 7 of the underlying container 1 is engaged in the rim 13 of the upper container 1;

The arch 18 of the upper container 1 is applied against the tapered area 7 of the underlying container 1.

As we have seen, the variability of the radius R and in particular the minimum value Rm facing the vertices 12 ensures that a smaller quantity of material is necessary for the formation of the seat 9 in the sides of the polygon, enhancing a better blow-moldability of the container 1. In particular, a better formation of the placement perimeter 10 and therefore a better stability of the container 1 are ensured, in particular when it is stacked where the compression forces exerted on an underlying container can be more evenly distributed.

The invention claimed is:

1. Container (1) made of plastic material, comprising a body (2) with a polygonal cross-section that extends along a main axis (X), a shoulder (4) that forms an extension of the body (2) of an upper side, a neck (5) that forms an extension of the shoulder (4), and a bottom (3) that forms an extension of the body (2) of a lower side, with said bottom (3) comprising:

an annular seat (9) that defines a placement perimeter (10), with a polygonal contour formed by a number of sides and vertices, essentially perpendicular to the main axis (X);

a central peg (16) that has a side wall (17) that is tapered overall in revolution around the main axis (X) and that is connected to the rest of the bottom (3) by a connecting fillet (19), wherein the connecting fillet (19) has a variable radius (R) in revolution around the main axis (X) of the container (1), this radius (R) having a minimum value (Rm) in any sector (S1) delimited by a vertex (12) of the placement perimeter (10), and a maximum value (RM) in any sector (S2) delimited by a side (11) of the placement perimeter (10).

2. Container according to claim 1, wherein the radius (R) of the connecting fillet (19) has its maximum value (RM) in any bisecting plane at a side (11) of the placement perimeter.

3. Container according to claim 1, wherein the radius (R) of the connecting fillet (19) has its minimum value (Rm) in any bisecting plane at a vertex (12) of the placement perimeter (10).

4. Container according to claim 1, wherein the radius (R) of the connecting fillet (19) is continuously variable between its minimum value (Rm) and its maximum value (RM).

5. Container according to claim 1, wherein the maximum value (RM) and the minimum value (Rm) of the radius (R) of the connecting fillet are in a ratio of between 2 and 3.

6. Container according to claim 1, wherein the maximum value (RM) and the minimum value (Rm) of the radius (R) of the connecting fillet are in a ratio of approximately 2.5.

7. Container according to claim 1, wherein the placement perimeter (10) has a square contour that comprises four sides (11) and four vertices (12).

8. Container according to claim 7, wherein the radius (R) of the connecting fillet (19) has four maximum values (RM) facing the sides (11) and four minimum values (Rm) facing the vertices (12).

9. Container according to claim 1, wherein the radius (R) of the connecting fillet (19) has sinusoidal variations in revolution around the main axis (X).

10. Container according to claim 1, wherein under the neck (5), the shoulder (4) comprises a tapered area (7) and, at its junction with the body (2), a peripheral support face (8), with a polygonal contour, complementary to the placement perimeter (10) defined by the annular seat (9), essentially perpendicular to the main axis (X).

11. Container according to claim 2, wherein the radius (R) of the connecting fillet (19) has its minimum value (Rm) in any bisecting plane at a vertex (12) of the placement perimeter (10).

12. Container according to claim 2, wherein the radius (R) of the connecting fillet (19) is continuously variable between its minimum value (Rm) and its maximum value (RM).

13. Container according to claim 2, wherein the maximum value (RM) and the minimum value (Rm) of the radius (R) of the connecting fillet are in a ratio of between 2 and 3.

14. Container according to claim 2, wherein the maximum value (RM) and the minimum value (Rm) of the radius (R) of the connecting fillet are in a ratio of approximately 2.5.

15. Container according to claim 2, wherein the placement perimeter (10) has a square contour that comprises four sides (11) and four vertices (12).

16. Container according to claim 2, wherein the radius (R) of the connecting fillet (19) has sinusoidal variations in revolution around the main axis (X).

17. Container according to claim 2, wherein under the neck (5), the shoulder (4) comprises a tapered area (7) and, at its junction with the body (2), a peripheral support face (8), with a polygonal contour, complementary to the placement perimeter (10) defined by the annular seat (9), essentially perpendicular to the main axis (X).

* * * * *